United States Patent [19]

Saur et al.

[11] 4,225,841

[45] Sep. 30, 1980

[54] TEMPERATURE-DEPENDENT SWITCH

[75] Inventors: Roland Saur, Stuttgart; Manfred Kurz, Ditzingen, both of Fed. Rep. of Germany

[73] Assignee: Behr-Thomson Dehnstoffregler GmbH, Kornwestheim, Fed. Rep. of Germany

[21] Appl. No.: 925,829

[22] Filed: Jul. 18, 1978

[30] Foreign Application Priority Data

Jul. 21, 1977 [DE] Fed. Rep. of Germany ..... 2733045
Nov. 5, 1977 [DE] Fed. Rep. of Germany ..... 2749615

[51] Int. Cl.[2] ..... H01H 37/46
[52] U.S. Cl. ..... 337/393; 337/123
[58] Field of Search ..... 337/123, 137, 139, 393, 337/394, 396, 399

[56] References Cited

U.S. PATENT DOCUMENTS

| | | | |
|---|---|---|---|
| 3,212,337 | 10/1965 | McCanrick | 337/393 X |
| 3,531,752 | 9/1970 | Gourley | 337/394 X |
| 3,686,857 | 8/1972 | Berg | 337/393 X |
| 3,774,136 | 11/1973 | Zelenka | 337/123 X |
| 4,034,265 | 7/1977 | DuRocher et al. | 337/139 X |

*Primary Examiner*—R. L. Moses
*Attorney, Agent, or Firm*—Browdy and Neimark

[57] ABSTRACT

A temperature-dependent switch is provided with a substance, which expands when heated in a housing, and a transmission part. The transmission part is displaceable by a diaphragm, a sealing part, accepting a beaded edge on the diaphragm with an annular groove is included. The integral housing serves to accept the substance which expands or contracts as a function of temperature, the sealing part, the diaphragm and the transmission part. A prong plate is fastened to housing for at least one electrical prong. The scaling part is provided with at least one recess to accept an insulating part. The transmission part is effectively connected with an electrical prong.

29 Claims, 7 Drawing Figures

9'
9"
8
8
21
19
30
30
20"
17
20'
18
28
28
29
29
23
22
14
15
13
11
11
6
6
4
7
1
5
5
4
7
3
3
10
10
2
2

TEMPERATURE-DEPENDENT SWITCH

BACKGROUND OF THE INVENTION

This invention relates to a temperature-dependent switch, with a material in a housing, the material expanding when heated, and a transmission part, displaceable by a diaphragm, and a sealing part, this part having an annular groove which receives a bead on the edge of the diaphragm.

Temperature-dependent switches, wherein a substance which expands when heated in a housing, for example a gas, a liquid, or a solid, e.g. wax, displaces a transmission part and then actuates a switch, a valve, or similar element are known. Such temperature-dependent switches make it possible to trigger a specific switching or positioning process when the fluid flowing around the switch is at a precisely defined temperature.

There is also a need to provide a single-pole normally-open switch, which closes at a certain temperature, or on the other hand, a single-pole normally-closed switch, for example to shut off an electrical heater for a carburetor or the like.

SUMMARY OF THE INVENTION

Hence, it is an object of the invention is to design a temperature-dependent switch of the type described hereinabove in such manner that it opens or closes an electrical circuit in a simple, precisely reproducible fashion, whereby the switch elements are integrated in the switch.

It is often necessary to initiate switching processes at two limiting temperature values and/or to use a two-stage temperature switch. It is known for example to turn on a warning light in motor vehicles when a predetermined temperature is exceeded in the coolant. It is also known to display the temperature of a coolant in analog form, i.e. continuously. However, this can result in incorrect interpretations when read.

The invention also has the goal of providing a temperature dependent switch in such manner that a combined two-stage temperature switch is formed in simple fashion, said switch being usable for independent closing or opening of two circuits as a function of a minimum and a maximum temperature.

These objects are achieved according to the invention in a temperature-dependent switch of the type described hereinabove essentially by virtue of the fact that a one-piece housing serves to hold the substance which expands or contracts as a function of temperature, the sealing part, the diaphragm, and the transmission part, by the fact that a prong plate for at least one electrical prong is mounted on the housing, by the fact that the sealing part has at least one recess to accept an insulating part, and by the fact that the transmission part is actively connected with an electrical contact element.

A temperature-dependent switch of this type permits an electrical circuit to be interrupted in a simple, exactly reproducible fashion, whereby the switch elements are integrated in the switch.

These objects are also achieved in the temperature-dependent switch of the type described hereinabove according to the invention by virtue of the fact that the transmission part is designed as a normally closed and normally open switch, and is provided with a pressure-sensitive switching element.

The temperature-dependent switch of the type described hereinabove is further designed advantageously according to the invention in such fashion that at least one posistor switching element is provided for one or more additional circuits.

The invention can be used advantageously in a plurality of embodiments.

According to a first embodiment of the invention, two prongs are provided, said prongs being provided with contact parts displaced approximately 180°, said parts pointing above the sealing part approximately at right angles to the direction of displacement of the transmission part by the fact that a working piston tensionable by the diaphragm is provided as a transmission part, and by the fact that the working piston is connected with an approximately U-shaped contact element, the element linking the two contact parts in the resting state. This embodiment is a type of proximity switch, whereby the two poles of a switch can be brought together or separated by a contact element moved by the working piston.

It is especially advantageous if the contacts are made in the shape of legs and integral with the prongs.

In order to ensure reliable return when the material which expands when heated cools, it is advantageous to provide a return spring for the working piston, the spring on the one hand abutting a recess in the prong plate and on the other hand abutting the leg of the U-shaped contact element.

Advantageously, the sealing part is provided with an insulating disc surrounding the working piston, the disc fitting into an approximately circular recess.

According to another embodiment of the invention, the insulating disc is provided with at least one and preferably two cup-shaped recesses displaced relative to one another through approximately 180°, in the vicinity of the lower end of the prongs and pressure-sensitive switching elements are disposed in these recesses, said switching elements being actuatable by the working piston through the U-shaped contact element. Pressure-sensitive switching elements of this type are known, whereby the switching element is normally nonconducting, but is rendered conducting as a function of compressive force. Switching elements of this type consist of a nonconducting elastomer in which a plurality of discrete electrically conducting particles are embedded.

According to another embodiment, it is advantageous for an insulating disc to serve as the transmission part.

The diameter of the pressure-sensitive elastically deformable switching element, in the state in which it is not stressed by the transmission part, is smaller than the inside diameter of a through opening in the sealing part. This ensures that when the switching element is deformed due to the expansion of the thermally expandable material in the housing, a contact is produced between the sealing part, the switching element, and the prongs. It is advantageous in this respect to provide a prong with a contact foot bent at an angle, the foot being in contact with the pressure-sensitive elastically deformable switching element.

In an especially advantageous improvement of the invention, the housing is connected with a tube or tube section guiding a control fluid, in such manner that the lengthwise axis of the tube and the direction of displacement of the transmission element are approximately at right angles to one another. The switch is therefore enclosed in the jacket of a tube containing a fluid at right angles to the flow direction.

In an advantageous further design of this embodiment, the housing is made integral with the tube wall.

It is especially advantageous if a contact element is provided, the element cooperating with a pressure-sensitive switching element in the sealing part, said element being disposed inside an insulating jacket and being held against the prong plate by a return spring.

According to a preferred embodiment of the invention, the pressure-sensitive switching element is disposed in a recess at the end of the transmission part designed as a working piston which is turned away from the diaphragm. For simplified assembly and reliable mounting of the pressure-sensitive switching element, the recess is provided in the transmission part with an undercut which engages an annular groove on the pressure-sensitive switching element.

It is especially advantageous if the insulating sleeve rests against pressure-sensitive switching elements and also abuts the contact feet of the prongs.

According to another embodiment of the invention, two pressure-sensitive switching elements are disposed in the insulating disc, one of said elements abutting the sealing part in an electrically conducting manner.

The improvement of the invention is based on the fact that posistor-type resistors are conducting in the cold state and that the self-heating which occurs as the current passes through can be neglected if the connected load is made appropriately small and on the other hand any self-heating which is generated can be carried away to the environment by appropriately dimensioned heat-conducting surfaces.

In a switching device according to the invention, a current flows via the posistor to the connected contact until a certain temperature is reached, the temperature being determined by the sensing part of the switching device. If the influence of the sensor temperature causes the blocking temperature specified for the posistor to be exceeded, the internal resistance increases so sharply that no further current can flow.

Significant advantages of the switch according to the invention lie in the lower cost of adjustment, assembly of the individual parts, and maintenance of the appropriate manufacturing tolerances.

According to a preferred embodiment, it is advantageous if two prongs are provided, the prongs being provided with contacts which point above the sealing part approximately at right angles to the displacement direction of the transmission part, by the fact that an insulating disc serves as a transmission part, and by the fact that the electrical contact element consists of a pressure-sensitive elastically deformable switching element.

The posistor switching element provided according to the invention can be disposed on any internal or external point on the switch. Preferably, the posistor switching element, however, is disposed inside the integral housing. According to an especially advantageous embodiment, the posistor switching element is provided between the sealing part and the prong plate. It is advantageous in this design for the posistor switching element to rest upon the sealing part. Simple assembly is achieved if, according to another feature of the invention, the posistor switching element is made in the form of a circular ring. It is also advantageous if a contact ring, provided with finger-like springs resting on the posistor switching element, is provided between the circularly annular posistor switching element and a prong in the prong plate.

In a modified embodiment, the posistor or posistors are made disc-shaped and are mounted in the sealing part, preferably in appropriate recesses.

In the latter embodiments, it is advantageous if a contact ring is used, the ring being provided with finger-like springs and linking disc-shaped posistor switching elements with a prong in the prong plate.

An especially preferred application of a temperature-dependent switching element according to the invention is used for indicating the operating temperature and excess temperature of a coolant in the coolant circuit of a motor vehicle.

BRIEF DESCRIPTION OF THE DRAWINGS

Further advantages and features of the invention will be discussed in greater detail with reference to the drawing which shows embodiments in schematic form.

DETAILED DESCRIPTION OF THE PREFERRED EMBODIMENTS

Figures 1A, 1B:
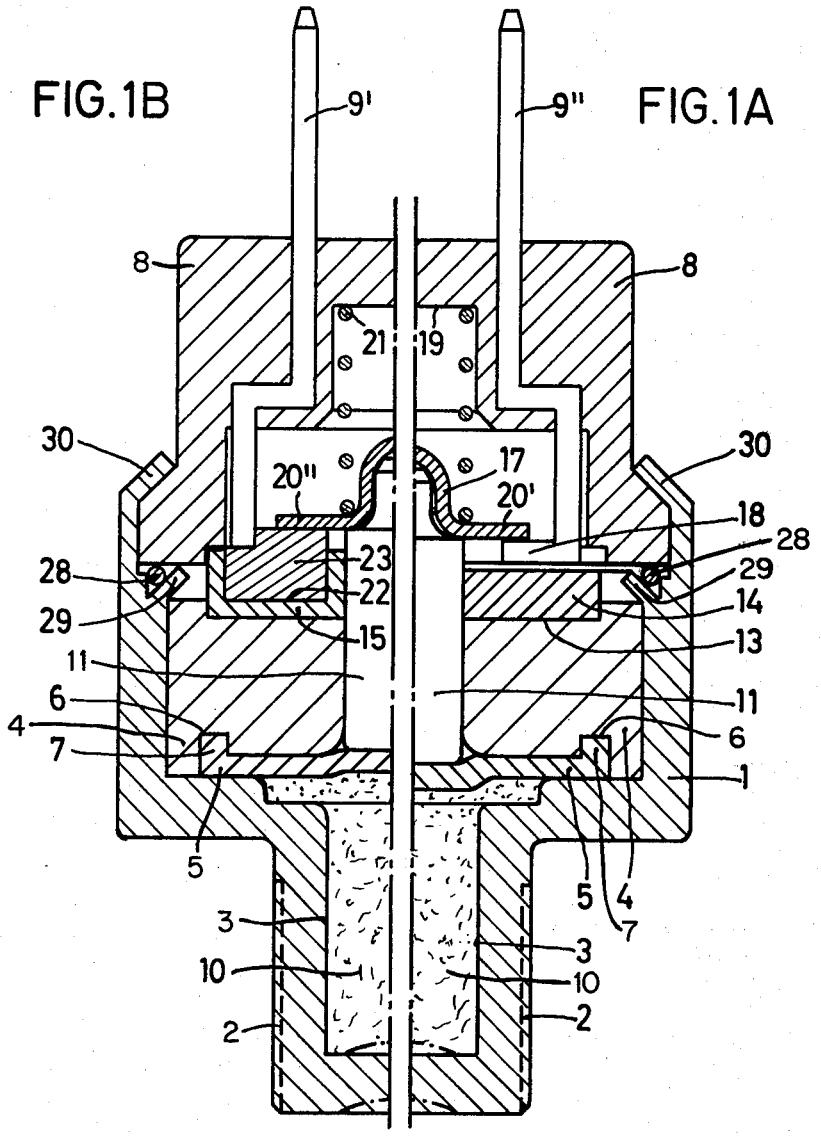
FIGS. 1A and 1B show respectively two different embodiments according to the present invention, one-half of each embodiment being shown in each case, the other being a minor image, and these figures being shown closely adjacent to show elements common to both species.
Figure 2:
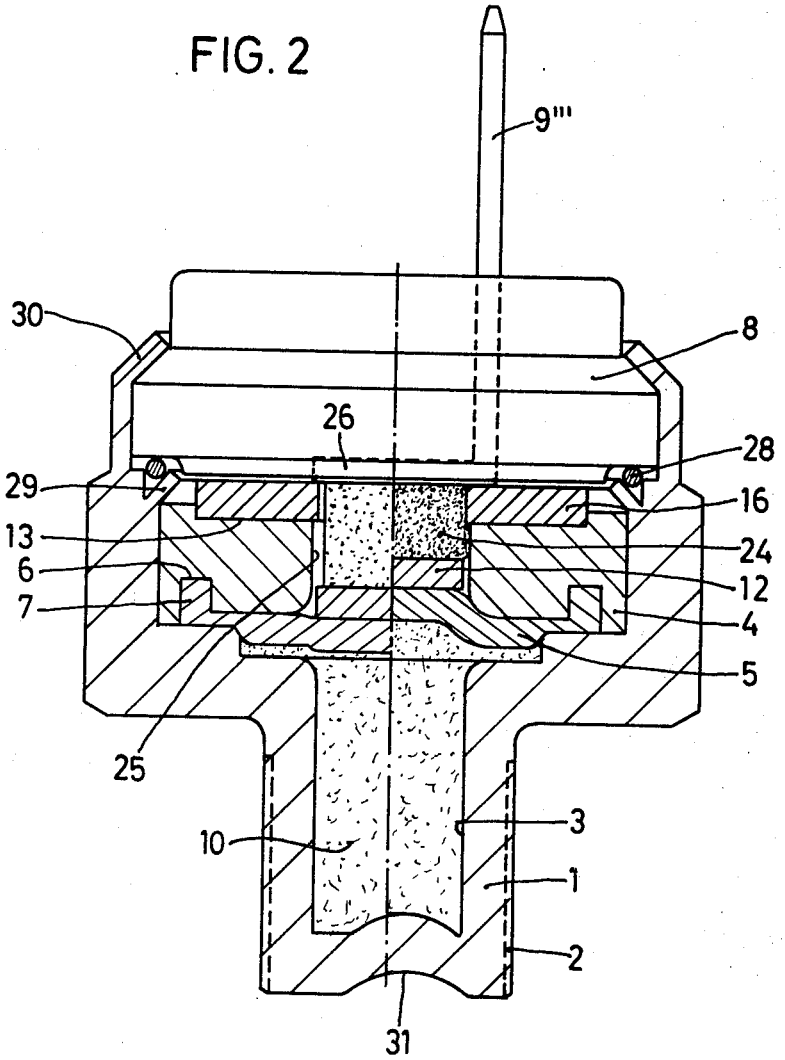
FIG. 2 is a side view of another embodiment, partially cut away.

It is apparent from FIGS. 1A, 1B and 2 that a switching device according to the invention includes an integral housing 1, possibly provided with an external thread 2. A material 10, which expands when heated and contracts when cooled, is contained in a cavity 3. Cavity 3 is covered by an elastic diaphragm 5, the diaphragm being firmly compressed in turn by a sealing part 4. Sealing part 4 is provided with an annular groove 6, into which a bead 7 of diaphragm 5 fits. With the aid of an internal bead 29, sealing part 4 and hence diaphragm 5 are immobilized in the interior of the housing. A prong plate 8 with at least one electrical prong 9'' (FIG. 1A), 9' (FIG. 1B) or 9''' (FIG. 2) is fastened to the upper part of housing 1, preferably by turning over an outer edge 30. An O-ring 28 is provided as a seal between prong plate 8 and inner bead 29.

In the embodiment shown FIG. 1A, the working piston 11 is movably guided in an opening in sealing part 4, the piston being tensioned by diaphragm 5. The upper, preferably tapered end of piston 11 is connected with an electrical contact element 17, the latter being somewhat hat-shaped and being provided with legs 20' and 20''. Sealing part 4 is provided with an upper recess 13, into which an insulating disc 14 roughly circular in shape is mounted. A prong 9'' is mounted on contact plate 8, the prong making a transition at its upper part to a contact part 18 which points radially inward. Similarly, a second prong 9' is provided, with a lower (not shown) contact part, which is located in a position in which it is approximately 180° displaced relative to contact part 18. If the control fluid has a temperature below the release temperature of the material 10 which expands when heated, legs 20' and 20'' of electrical contact element 17 rest upon the two contact parts 18 of prongs 9' and 9'', closing the circuit. If material 10 expands, piston 11 (in the drawing) is displaced upward, taking electrical contact part 17 with it, whereby legs 20' and 20'' are lifted from the electrical contacts 18 and break the circuit. In order to be able to return working piston 11 reliably to its original position when material 10 cools and contracts accordingly, a return spring 21 is advantageously provided, the spring abutting on the one hand a recess 19 in prong plate 8 and on the other hand legs 20' and 20'' of electrical contact element 17. The design of housing 1 with material 10 in a cavity 3 in the second embodiment shown in FIG. 1B in the left-hand side of the figure is similar to the first embodiment described above. In this embodiment, recess 13 of sealing part 4 contains two cup-shaped recesses 22 located approximately 180° apart, in an insulating disc 15. Pressure-sensitive elastically deformable switching elements 23 are inserted in these cup-shaped recesses. Prongs 9' press against the surfaces of switching elements 23, whereby the pressure is produced and ensured especially during assembly by turning over edge 30. In a temperature range below the expansion temperature of material 10, electrical contact element 17, under the action of spring 21, likewise is pressed against deformable switching elements 23. This compressive pressure makes switching element 23 conducting, so that the electrical connection to prong 9 is ensured. If material 10 expands, electrical contact element 17 above piston 11 is pushed upward against the action of spring 21, so that deformation of electrical switching element 23 is either reduced or eliminated. Depending on the characteristic curve of the switching element 23, the conductivity is interrupted either immediately or gradually.

The embodiment shown in FIG. 2 corresponds theoretically essentially to the embodiments in FIGS. 1A and 1B, however, in this embodiment, a pressure-sensitive, elastically deformable switching element 24 is disposed in a through opening 25 in sealing part 4. This switching element 24 rests upon a transmission disc 12, which acts as a transmission part. In a recess 13 in sealing part 4, an insulating disc 16 is once more provided. Insulating disc 16 is made in the form of a circular ring, whereby the internal diameter is less than the inside diameter of the through opening 25 in sealing part 4. On the other hand, the outside diameter of pressure-sensitive switching element 24 is again smaller than the inside diameter of insulating disc 16 and smaller than the inside diameter of through opening 25 in the unstressed state.

When material 10 expands when heated appropriately, transmission disc 25 is displaced upward by diaphragm 5 and exerts a compressive force upon the switching element 24. A prong 9''', disposed in prong plate 8, is provided with a lower contact foot 26, made approximately in the form of a disc bent at right angles. Contact foot 26 covers wholly or partially the opening in the circularly annular insulating disc 16. The movement of transmission disc 12 causes switching element 24 to be compressed between transmission disc 12 and contact foot 26. This results in a deformation such that the diameter of the switching element 24 is increased, so that it fills the through opening 25 in the appropriate region and forms an electrically conducting connection with sealing part 4. In this embodiment, prong 9''' is one pole and housing 1 is the second pole of a single-pole normally open switch. By means of the transmission disc 12, switching element 24 is also pressed radially outward by pressure in the axial direction, whereby, after applying switching element 24 against sealing part 4, by further deformation of the switching element, the metal parts of the switching element which are kept apart by the elastomer are brought into contact, so that a current can flow from prong 9''', which is made for example in the form of a flat prong, by a switching element 24 of sealing part 4 to external thread 2 of housing 1 and hence to ground.

In this embodiment, the elastically deformable switching element 24 itself acts as a return element for transmission disc 12 or diaphragm 5.

High accuracy for the switching point as a function of temperature can be achieved by adjusting the bottom of housing 1 with the aid of an adjusting notch 31.

Figure 3:
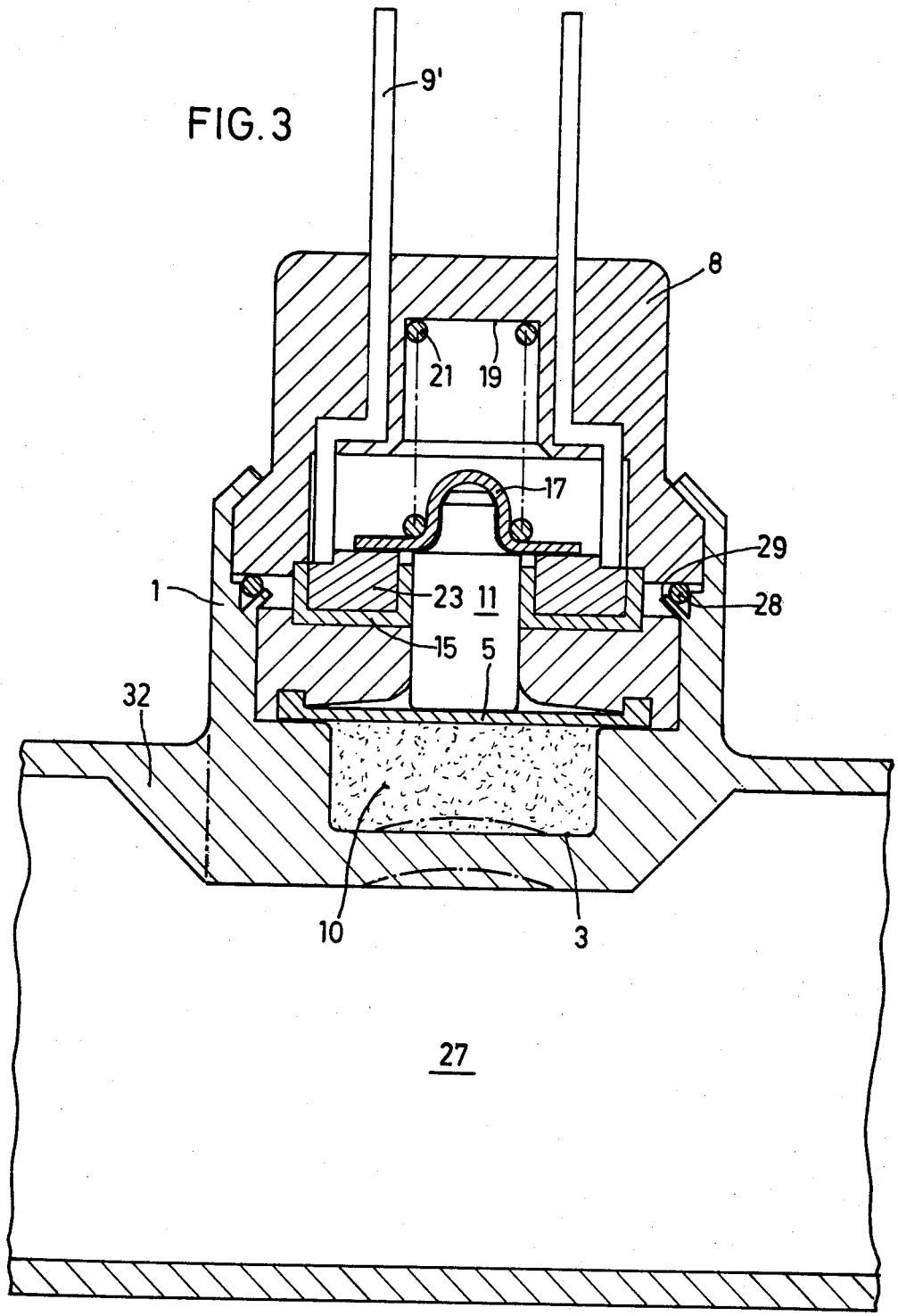
FIG. 3 is a partially cut away side view of an embodiment with a modified type of housing.

The Embodiment shown in FIG. 3 essentially corresponds to FIG. 1B, but housing 1 is inserted in a tubular wall 32 of a tube 27 or made integral with this tube wall 32. Tube 27 serves as a conductor for a control fluid whose temperature controls the temperature-dependent switching device according to the invention in the manner described above.

Figure 4:
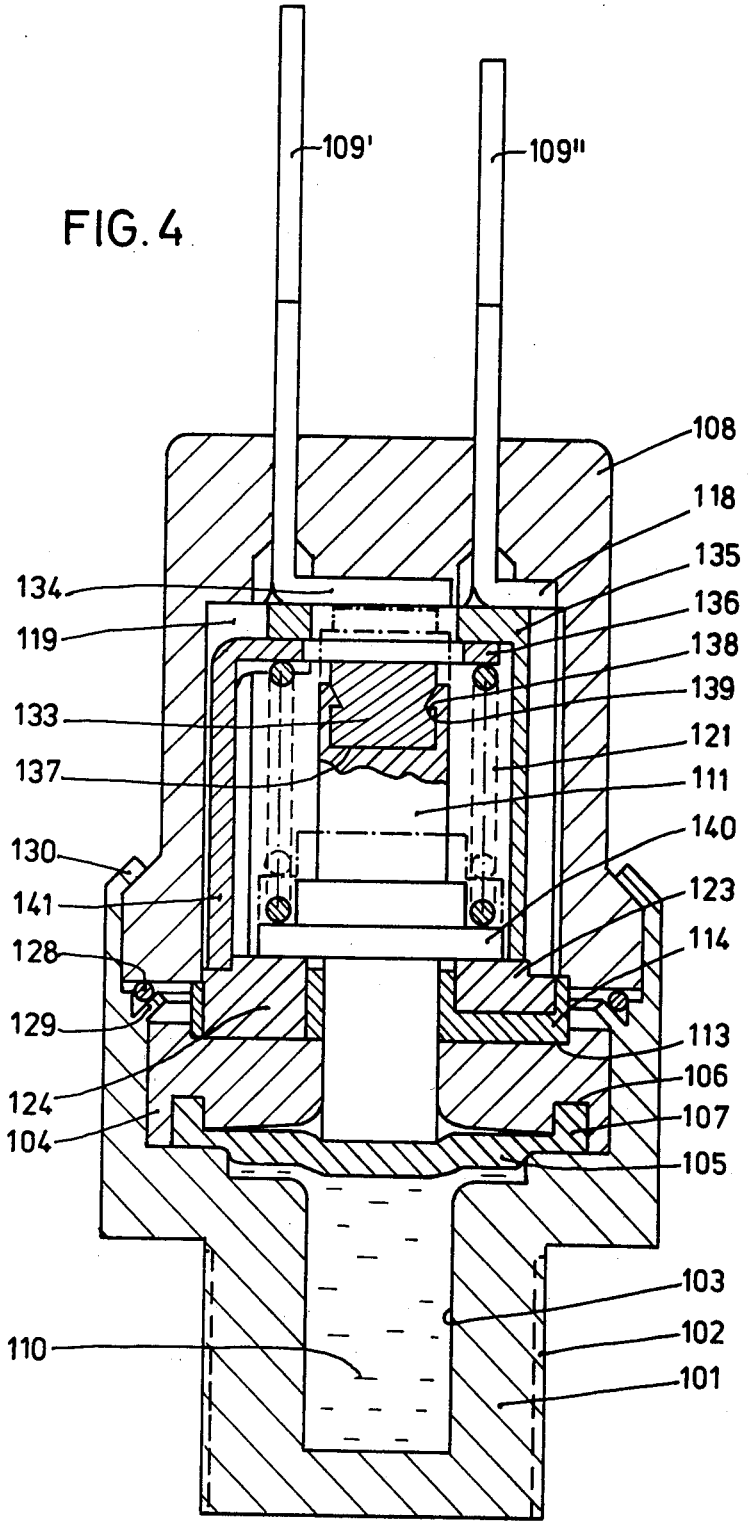
FIG. 4 is a partially cut away side view of an embodiment of an improvement to the invention.

In the embodiment shown in FIG. 4, a substance 110 is provided in a cavity 103 of a housing 101, the housing possibly being provided with an external thread 102, the substance expanding when heated and contracting when cooled. Cavity 103 is covered by an elastic diaphragm 105, the diaphragm in turn being compressed by a sealing part 104. Sealing part 104 is provided with an annular groove 106, into which a bead 107 on diaphragm 105 engages. With the aid of an internal beaded edge 129, sealing part 104 and hence diaphragm 105 are firmly installed inside the housing. At the upper part of housing 101, a prong plate 108 with two electrical prongs 109', 109'', is held in place, preferably by turning over an outer beaded edge 130. An O-ring 128 is provided as a seal between prong plate 108 and inside beaded edge 129.

A working piston 111 is movably guided as a transmission part through an opening in sealing part 104, the piston being tensioned by diaphragm 105.

Working piston 111 comprises a disc edge 140, against which a return spring 121 abuts. Sealing part 104 is provided with an upper recess 113, into which an insulating disc 114 approximately circularly annular in shape is inserted. A pressure-sensitive switching element 123 is disposed in insulating disc 114. The pressure-sensitive switching element 123 is elastically deformable. Compressive pressure makes switching element 123 conducting. Such pressure-sensitive switching elements are known.

An insulating sleeve 135 is placed on top of pressure-sensitive switching element 123. A contact element 136 projects through an opening in insulating sleeve 135, said element extending with a contact tab 141 as far as a second pressure-sensitive switching element 124 in insulating disc 114. Return spring 121 presses contact element 136 against the upper part of insulating sleeve 135, which in turn abuts contact feet 118 and 134 of prongs 109' and 109''.

Working piston 111 is provided on the end which is opposite diaphragm 105 with a recess 137, into which an additional pressure-sensitive switching element 133 is inserted. In this regard, the design is preferably modified so that recess 137 comprises an undercut 138, the undercut engaging an annular groove 139 in pressure-sensitive switching element 133, whereby the insertion of switching element 133 in recess 137 is simplified and a more reliable retention is ensured.

The switch according to the invention allows two circuits to be actuated, each of which has one side at ground. If a fluid surrounding the switch, for example the coolant in a coolant circuit of an internal combustion engine, has not yet reached its working temperature, piston 111 is in the extended position shown at the bottom. The flow is therefore over prong 109'', which extends with its contact 118 as far as pressure-sensitive switching element 123, via this pressure-sensitive switching element 123, disc edge 140 of working piston 111, return spring 121, and the contact element 136 with contact tab 141 as far as a second pressure-sensitive switching element 124, and thence via sealing part 104 in housing 101, to ground.

When the fluid reaches a specified operating temperature, working piston 111 (shown at the top in the drawing) moves, whereby the edge of the disc 140 lifts off pressure-sensitive switching element 123. This breaks the circuit and extinguishes for example a pilot light, which may be connected, whereby for example the driver of a motor vehicle is warned that the coolant has reached its operating temperature. If the temperature of the ambient fluid continues to rise, temperature-dependent substance 110 will continue expanding, so that eventually working piston 111 will be displaced by diaphragm 105 into an upper position (represented by the dot-dashed lines in the drawing), until pressure-sensitive switching element 133 comes to rest against contact foot 134 of prong 109'. This creates a circuit between prong 109', contact foot 134, pressure-sensitive switching element 133, working piston 111, return spring 121, contact element 136 with contact tab 141 and thence, as in the case described above, via pressure-sensitive switching element 124, and sealing part 104 in housing 101 to ground. In an application according to the invention of the temperature-dependent switching element to indicate the operating state of a coolant circuit in motor vehicles, a warning light is actuated indicating to the driver that a problem has occurred, resulting in the temperature of the coolant having become impermissibly high. Instead of the optical signal, an acoustic signal or both an optical and an acoustic signal can be actuated. When the ambient fluid cools down again, the temperature-dependent substance 110 contracts, working piston 111 is pushed downward by return spring 121, so that the electrical contact between the pressure-sensitive switching element 133 disposed in working piston 111 and contact foot 134 of prong 109' is broken. In the embodiments shown in FIGS. 5 and 6, a substance 210 which expands when heated and contracts when cooled is provided in a cavity 203 of housing 201, which may possibly be provided with an external thread 202. Cavity 203 is covered by an elastic diaphragm 205, which is firmly pressed in turn by a sealing part 204. Sealing part 204 is provided with an annular groove 206, into which a bead 207 of diaphragm 205 fits. With the aid of an inner bead edge 229, sealing part 204 and hence diaphragm 205 are held firmly in the interior of the housing. A prong plate 208 with two electrical prongs 209', 209'' is fastened to the upper part of housing 201, preferably by turning over an outer beaded edge 230. An O-ring 228 is provided as a seal between prong plate 208 and inner beaded edge 229. A transmission part is movably guided through an opening 225 in sealing part 204, said transmission part being tensioned by diaphragm 205. In the embodiment shown, the transmission part consists of a transmission disc 212, upon which a pressure-sensitive switching element 224 rests and/or is fastened.

Sealing part 204 is provided with an upper recess 213, into which an insulating disc 214 with an approximately circularly annular shape is inserted.

Pressure-sensitive switching element 224 is elastically deformable. At a certain compressive pressure, switching element 224 becomes conducting. Pressure-sensitive switching elements of this type are known of themselves. In the left half of FIG. 5, switching element 224 is shown, elastically depressed by the pressure exerted by transmission disc 212 tensioned by diaphragm 205.

Figure 5:
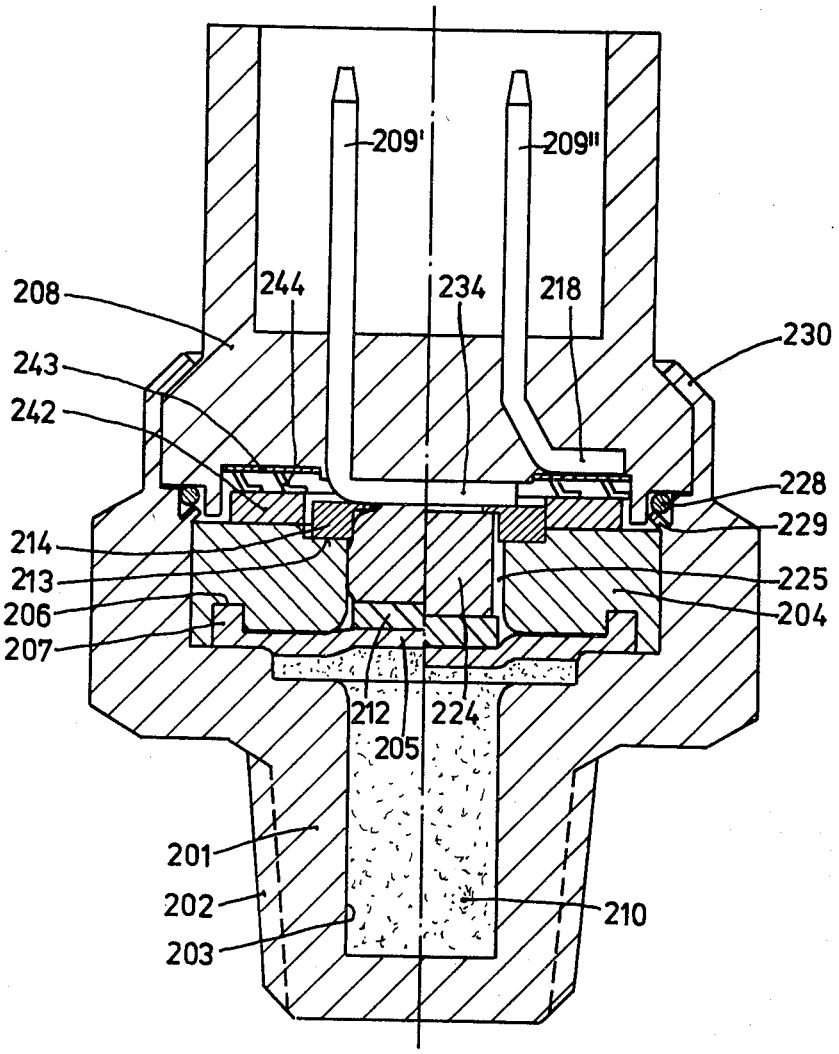
FIG. 5 is a partially cut away side view of another embodiment with a circularly annular posistor switching element.
Figure 6:
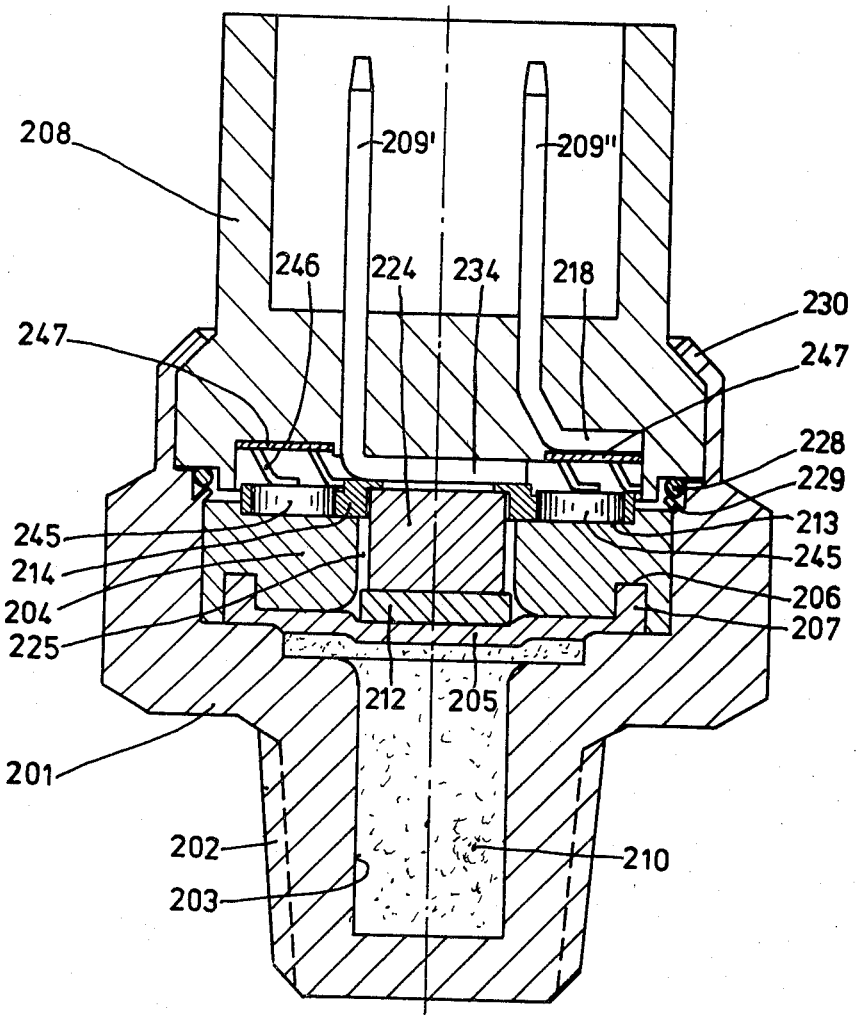
FIG. 6 is a partially cut away side view of an embodiment modified relative to the embodiment shown in FIG. 5, with disc-shaped posistor switching elements.

In the embodiment shown in FIG. 5, a posistor switching element 242 is provided according to the invention, the switching element being made circularly annular and disposed on sealing part 204. Between the lower bottom surface of prong plate 208 and posistor switching element 242, a contact ring 243, likewise circularly annular, is provided with spring tongues 244, the tongues resting upon posistor switching element 242. The spring tongues serve to fasten and compensate for the tolerance of the posistor switching element and also to conduct electricity. In the modified embodiment shown in FIG. 6, instead of a circularly annular posistor switching element 242, at least one disc-shaped posistor switching element 245 is provided. In the embodiment shown, two such disc-shaped posistor switching elements 245 are shown, not cut away. In this embodiment as well, a circularly annular contact ring 247 is provided, said ring resting with springs 246 upon the individual disc-shaped posistors 245. The rest of the design of the embodiment shown in FIG. 6 corresponds to the embodiment shown in FIG. 5.

The two prongs 209' and 209'' are provided with contact feet 218 and 234, said feet being bent approximately at right angles to the lengthwise axis of the device. This affects the design in such manner that contact foot 234 of prong 209' comes into contact with the pressure-sensitive switching element 224, when the heat-expandable substance 210 expands in response to an appropriate temperature rise in the device and the transmission part (in the drawing) is displaced upward. On the other hand, contact part 218 of prong 209'' is in electrically conducting contact with contact rings 243 and 247.

In the switch designed according to the invention, two circuits can be actuated, each of which has one side connected to ground. If a fluid surrounding the switch, for example the coolant in the cooling circuit of an internal combustion engine, has not yet reached its working temperature, the transmission part, consisting of transmission disc 212 and pressure-sensitive switching element 224 is in the lower position shown in FIGS. 5 and 6 of the drawing. The liquid flow then passes over prong 209'', which has its contact part 218 extending up to posistor-switching element 242 or 245, over the latter, and past sealing part 204 as well as housing 201, which is connected to ground.

When the temperature of the fluid increases, housing 201 is likewise heated and therefore the posistor-switching element as well. When the predetermined blocking temperature is exceeded, the increase in the internal resistance of the posistor interrupts the flow of current. This interruption of the circuit can cause for example a connected pilot light to go out, whereby for example the driver of the motor vehicle is provided with a signal that the coolant has reached its operating temperature.

If the temperature of the ambient fluid continues to rise, temperature-dependent substance 210 continues to expand, so that eventually pressure-sensitive switching element 224 is displaced into an upper position by diaphragm 205 until this switching element comes to rest against contact foot 234 of prong 209'. This creates a circuit between prong 209', contact foot 234, elastically deformed (and at least partially resting in a conducting manner against sealing part 204) pressure-sensitive switching element 224, transmission disc 212 and housing 201 to ground. This turns on a warning lamp which indicates that a defect is present causing the temperature of the coolant to rise to an impermissibly high level. When the ambient fluid, for example cooling water, cools down, the temperature-dependent substance 210 contracts, pressure-sensitive switching element 224 expands axially, and forces diaphragm 205 downward. This breaks the electrical contact between pressure-sensitive switching element 224 and contact foot 234 of prong 209', as in the embodiment shown in FIG. 4.

Posistors of the type shown are known as "PTC resistors".

In the arrangement according to the invention of the posistor-switching element(s) 242 and/or 245 on sealing part 204, an appropriately large heat-conducting surface is provided for the heating of the posistor itself in a favorable manner by virtue of the fact that a large contact area is provided.

Instead of diaphragm 205 and transmission parts 212 and/or 224, a working piston can also be used, said piston extending into cavity 203 and being covered by a diaphragm, the piston forcing parts 212 and 224 upward when material 210, which expands when heated, expands.

Furthermore, the posistor-switching element(s) can be disposed on other parts of housing 201, for example on the bottom. In this case, an appropriate insulating disc is provided as well as an electrical connection for the posistor-switching element, while the second connection can run directly via housing 201 to ground.

The invention is not limited to the embodiments shown and described. It also includes all improvements and modifications made by an individual skilled in the art as well as partial and subcombinations of the features and means described and/or shown.

We claim:

1. In a temperature-dependent switch having a substance which expands when heated in a housing, a diaphragm positioned over the substance and a sealing part positioned over the diaphragm accepting a beaded edge on the diaphragm within an annular groove, the improvement wherein said housing is an integral housing, said substance (10) which expands or contracts as a function of temperature is positioned in a recess in said housing, said sealing part (4) and said diaphragm (5) also are positioned in said housing, and a transmission part (11 and/or 12), also positioned in said housing is coupled to said diaphragm, a prong plate (8) is fastened to said housing (1) for supporting at least one electrical prong, said sealing part (4) being provided with at least one recess (13), and an insulating part (14 and/or 15 and/or 16) positioned in said at least one recess, said transmission part (11 and/or 12) being effectively connected with said electrical prong.

2. Switch according to claim 1, characterized by the fact that said at least one electrical prong comprises two prongs (9', 9''), said prongs being provided with contact parts (8) displaced by approximately 180°, said parts pointing at right angles to the direction of displacement of the transmission part by the fact that a working piston (11), tensionable by diaphragm (5), is provided as the transmission part, and by the fact that working piston (11) is connected with a contact element (17), which is approximately U-shaped and links the two contact parts (18) in the resting state.

3. Switch according to claim 2, characterized by the fact that said contact parts (18) are made in the form of legs and are integral with prongs (9' and 9'').

4. Switch according to claim 2, characterized by a return spring (21) for said working piston (11), said spring abutting at one end a recess (19) in said prong plate (8) and abutting at other end the legs (20', 20'') of said contact element (17).

5. Switch according to claim 1 characterized by the fact that said sealing part (4) supports an insulating disc (14 or 15) surrounding a working piston (11) in an approximately circularly annular recess (13), said piston constituting said transmission part.

6. Switch according to claim 5 characterized by the fact that said insulating disc (15) is provided with two cup-shaped recesses (22), said recesses being displaced approximately 180° with respect to one another, in the vicinity of the lower end of said prong (9'), and by the fact that pressure-sensitive switching elements (23) are disposed in said recesses (22), said element being tensionable by said working piston (11) via said contact element (17), said contact element being U-shaped.

7. Switch according to claim 1, characterized by the fact that an insulating disc (12) serves as said transmission part and by the fact that the electrical contact element consists of a pressure-sensitive elastically deformable switching element (24).

8. Switch according to claim 7, characterized by the fact that the diameter of the pressure-sensitive elastically deformable switching element (24), in the state in which it is not tensioned by said transmission part (12), is smaller than the inside diameter of a through opening (25) in said sealing part (4).

9. Switch according to claim 8, characterized by the fact that said insulating part comprises a further insulating disc (16) disposed in a circularly annular recess (13) of said sealing part (4), and by the fact that the inside diameter of said further insulating disc (16) is smaller than the inside diameter of a through opening (25) in said sealing part (4) but larger than the outside diameter of the pressure-sensitive elastically deformable switching element (24).

10. Switch according to claim 7, characterized by the fact that said prong (9''') is provided, with a bent contact foot (26) which is in contact with said pressure-sensitive elastically deformable switching element (24).

11. Switch according to claim 1, characterized by the fact that said housing (1) is connected with a tube (27) or tube section conducting a control fluid in such manner that the lengthwise axis of the tube and the displacement direction of the transmission element are approximately at right angles to one another.

12. Switch according to claim 11, characterized by the fact that said housing (1) is made integral with a wall of said tube (32).

13. Switch according to claim 1, characterized by the fact that said transmission part (111) is made in the form of a normally closed and normally open switch, and is provided with at least one pressure-sensitive switching element (133).

14. Switch according to claim 13, characterized by a contact element (136), said element cooperating with a pressure-sensitive switching element (123) in said sealing part (104), said element further being disposed inside an insulating sleeve (135) and held against said prong plate (108) by a return spring (121).

15. Switch according to claim 13, characterized by the fact that pressure-sensitive switching element (133) is disposed at the end of the transmission part which is made in the form of a working piston and is turned away from said diaphragm (105), in a recess (137).

16. Switch according to claim 15, characterized by the fact that said recess (137) is provided with an undercut (138) which engages an annular groove (139) on said pressure-sensitive switching element (133).

17. Switch according to claim 13 wherein said at least one prong is a plurality of prongs, characterized by the fact that an insulating sleeve (135) rests against a plurality of pressure-sensitive switching elements (123, 124) and abuts contact feel (118,134) of said prongs (109',109").

18. Switch according to claim 13 characterized by the fact that said at least one pressure-sensitive switching element comprises two pressure-sensitive switching elements (123, 124) disposed in an insulating disc (114), one of said elements (124) being an electrically conducting contact with said sealing part (104).

19. Temperature-dependent switch, with a substance which expands when heated in a housing, a transmission part displaceable by means of a diaphragm, a sealing part accepting a bead on the diaphragm in an annular groove, whereby an integral housing serves to accept the substance which expands or contracts as a function of temperature, the sealing part, the diaphragm, and the transmission part, and a prong plate for at least one electrical prong is fastened to the housing, the sealing part is provided with at least one recess to accept an insulating part, and the transmission part is effectively connected with an electrical prong, characterized by at least one posistor switching element (242, 245), for one or more additional circuits.

20. Switch according to claim 19, characterized by the fact that said at least one prong two prongs (209', 209"), said prongs being provided with contact parts (218) which point above sealing part (204) approximately at right angles to the direction of displacement of the transmission part, by the fact that an insulating disc (212) serves as the transmission part, and by the fact that the electrical contact element consists of a pressure-sensitive elastically deformable switching element (224).

21. Switch according to either claim 19 or claim 20, characterized by the fact that said posistor switching element (242) is disposed inside integral housing (201).

22. Switch according to claim 19, characterized by the fact that the posistor switching element (242) is disposed between said sealing part (204) and said prong plate (208).

23. Switch according to claim 22, characterized by the fact that the posistor switching element (242) rests upon said sealing part (204).

24. Switch according to claim 22 by the fact that the posistor switching element (242) is made in the form of an annular ring.

25. Switch according to claim 24 characterized by the fact that a contact ring (243) is provided with finger-like springs (244) resting on the posistor switching element (242), said ring being positioned between said ring-shaped positor switching element (242) and said prong (209") in said prong plate (208), said ring-shaped element being annular 26. Switch according to claim 19, claim 20, and claim 21, characterized by the fact that the posistor switching element (245) is/made disc-shaped and mounted on or in sealing part (204).

27. Switch according to claim 26, characterized by a contact ring (247), said contact ring being provided with finger-shaped springs (246), said springs connecting the disc-shaped posistor switching element (245) with said prong in said prong plate (208).

28. Use of a temperature-dependent switching element according to claim 1 to indicate the operating temperature and excess temperature of a coolant in the cooling circuit of a motor vehicle.

29. A temperature dependent switch, comprising;

a housing;

an expandable means, inside said housing, for expanding when heated and contracting when cooled a diaphragm having a bead therein in contact with said expandable means;

a sealing means, having an annular groove into which said bead of said diaphgram fits and also having a first opening therein, for pressing said diaphragm against said expandable means, said sealing means also having at least one recess therein at the end of said sealing means opposite from said diaphragm;

a transmission means, movable inside the opening in said sealing means, for moving in response to the expansion of said expandable means;

an insulating material, located in the recess in said sealing means;

a prong plate, fastened to said housing, having at least one electrical prong therein, wherein said transmission means contacts said electrical prong when said expandable means is in a contracted state.

* * * * *